US007309401B2

(12) United States Patent
Vogel et al.

(10) Patent No.: US 7,309,401 B2
(45) Date of Patent: Dec. 18, 2007

(54) TOP SEPARATOR FOR GAS PHASE AND HYDRAULIC PHASE CONTINUOUS DIGESTERS AND METHOD FOR CONVERTING DIGESTER

(75) Inventors: Keith P. Vogel, Queensbury, NY (US); John F. Bolles, Queensbury, NY (US); Patrick J. Sullivan, Argyle, NY (US); C. Bertil Stromberg, Bolton Landing, NY (US)

(73) Assignee: Andritz Inc., Glens Falls, NY (US)

( * ) Notice: Subject to any disclaimer, the term of this patent is extended or adjusted under 35 U.S.C. 154(b) by 623 days.

(21) Appl. No.: 10/823,763

(22) Filed: Apr. 14, 2004

(65) Prior Publication Data

US 2004/0226670 A1 Nov. 18, 2004

Related U.S. Application Data

(60) Provisional application No. 60/469,400, filed on May 12, 2003.

(51) Int. Cl.
*D21C 7/00* (2006.01)

(52) U.S. Cl. ..... 162/236; 162/237; 162/246; 162/52; 162/41

(58) Field of Classification Search ..... 162/52, 162/29, 246, 68, 245, 236, 41, 237
See application file for complete search history.

(56) References Cited

U.S. PATENT DOCUMENTS 5,882,477 A 3/1999 Laakso et al.
6,024,837 A * 2/2000 Laakso et al. ..... 162/237
6,086,717 A * 7/2000 Snekkenes et al. ..... 162/245
6,174,411 B1 1/2001 Laakso et al.
6,325,889 B2 * 12/2001 Snekkenes et al. ..... 162/41
6,332,954 B2 * 12/2001 Snekkenes ..... 162/239
2001/0000588 A1 5/2001 Snekkenes
2001/0023748 A1 9/2001 Marcoccia et al.
2001/0025694 A1 10/2001 Kettunen et al.
2001/0037865 A1 11/2001 Snekkenes et al.
2002/0026990 A1 3/2002 Miele et al.
2002/0059991 A1 5/2002 Barrett et al.
2002/0059992 A1 5/2002 Prough et al.
2002/0060024 A1 5/2002 Prough et al.
2003/0000661 A1 1/2003 Henricson et al.
2003/0062139 A1 4/2003 Vogel et al.
2003/0089470 A1 5/2003 Kettunen et al.
2003/0145963 A1 8/2003 Stromberg et al.
2003/0173047 A1 9/2003 Stromberg et al.
2003/0209335 A1 11/2003 Henricson et al.
2004/0112554 A1 6/2004 Snekkenes et al.
2004/0140068 A1 7/2004 Snekkenes

* cited by examiner

*Primary Examiner*—Mark Halpern
(74) *Attorney, Agent, or Firm*—Nixon & Vanderhye P.C.

(57) ABSTRACT

A continuous digester for producing chemical cellulose pulp from cellulose chips including: a digester vessel with an upper section attached to a top separator and said vessel at least partially filled with the cellulose chips and a liquor; a top separator at least partially in said upper section having a lower chip inlet port, a chip conveyor, a screen adjacent the conveyor, an upper chip discharge chute, and a liquor outlet facing a side of the screen opposite to the conveyor, and a chip inlet conduit extending into the vessel and having a first operational mode in fluid communication with the chip inlet port and a second operational mode in which the chip inlet conduit discharges directly into the vessel.

10 Claims, 4 Drawing Sheets

TOP SEPARATOR FOR GAS PHASE AND HYDRAULIC PHASE CONTINUOUS DIGESTERS AND METHOD FOR CONVERTING DIGESTER

RELATED APPLICATION

This application claims the benefit of the filing date and priority to U.S. Provisional Application 60/469,400, filed May 12, 2003.

FIELD OF INVENTION

The invention relates to vapor-phase and hydraulic-phase digesters used to process cellulosic fibers into pulp. In particular, the invention relates to top separators for such digesters.

BACKGROUND AND SUMMARY OF THE INVENTION

Digesters are pressure cooking vessels used to process cellulosic fibrous material, such as wood chips. The digester applies pressure and cooking liquor to process the chips into cellulose pulp from which paper products may be made. A digester vessel is generally a vertical column often having a height greater than 100 feet (about 30 meters). There are essentially two types of continuous digesters: a hydraulic digester and an dual-phase or vapor-phase digester (hereinafter referred to as a vapor-phase digester). A hydraulic digester is a pressure-resistant vessel which is filled with comminuted cellulosic fibrous material and liquid.

The vapor-phase digester includes a pressure vessel that is partially filled with a slurry of the cellulosic fiber and cooking liquor and has a super-atmospheric steam zone (also referred to as the gas zone) above the slurry. The gas in the vapor zone is compressible The pressure within a vapor-phase digester is typically determined by the pressure of the gas at the top of the digester.

Traditionally, wood chips are introduced into hydraulic and vapor phase digesters via mechanical top separators. However, the top separator for a hydraulic digester have typically been different than top separators for vapor-phase digesters. The top separators for both types of digesters have an input port coupled to a feed system. Wood chips, or other comminuted cellulosic fibrous material, are typically fed to continuous digester via the feed system and top separator. The feed system typically includes equipment for de-aerating, heating, pressurizing, and introducing cooking liquor to the chips before transferring a slurry of chips and liquor to the digester. Top separators have conventionally served to introduce chips into a digester and to extract cooking liquor from the input chip slurry. Top separators are used in hydraulic and vapor phase digesters.

In a hydraulic digester, the input slurry of chips and liquor is introduced to a top separator having a downward-directed screw-type conveyor. In the vapor-phase digester, the slurry of chips and liquor is transferred to a screw-type conveyor which moves the slurry upwards so that the chips and liquor overflow the top of the conveyor and fall freely in the steam-filled atmosphere of the digester. This upward flow and overflow of chips and liquid is suited to the vapor-phase digester because it prevents the escape of gas as the slurry is introduced to the digester while providing a weir-type reservoir for removing excess liquid. The top separator for a vapor-phase digester is known in the art as an "inverted top separator".

In a vapor-phase digester, the wood chips are typically heated by exposure to steam as the chips are introduced to the steam-filled zone at the top of the digester. A vapor-phase digester directly exposes chips to steam for heating by having a chip level that is above the level of the liquid in the digester. The chips are exposed to steam as they are distributed in the vessel by a top separator device and as they rest on the top of the chip pile.

In a vapor phase digester, the chips are "cooked" as they move from the top of the chip pile and progress down into the slurry through the digester vessel. The inverted top separator is mounted in the top section of the digester. The top section of the vessel contains a vapor portion, and the portion of the vessel below the vapor is filled with a liquid-chip slurry.

Top separators for hydraulic and vapor phase digesters remove excess liquid from the slurry. The removed liquid. e.g., liquor, is returned to the feed system (e.g. conventional high pressure feeder) as a source of slurrying liquid. The functions of the top separators for hydraulic and vapor phase digester are similar, but they have distinct applications to their respective type of digester.

The top separator is one of the few major components of a digester vessel that has conventionally had a substantially different construction depending on whether the separator is for a hydraulic or vapor phase digester. See U.S. Pat. Nos. 6,332,954 and 6,325,889. In a hydraulic digester, the top separator has an upper inlet for the chip slurry, a downwardly turning screw conveyor, a bottom chip discharge and the entire separator sits on top of a cone. The cone and the bottom of the separator form a top to the liquid and chip filled portion of the hydraulic digester vessel. In a vapor phase digester, the top separator is mounted directly in the gas filled portion of the vessel (without an underlying cone), has a bottom chip slurry inlet, an upwardly turning screw conveyor, and an annular chip discharge chute at the top of the separator.

Other than the top separator, the major components of the digester, e.g., vessel wall, screens, outlets and liquor piping, are generally common to both types of digesters. There are other differences between the structure of a vapor phase and hydraulic digesters, as is discussed in U.S. Pat. Nos. 6,174,411 and 5,882,477. In view of the differences between the top separators and other differences, vapor phase digesters have in the past not been interchangeable with or convertible to hydraulic digesters, and vice versa. However, there is a long felt need for commonality of components between the digester types and for an ability to convert one type of digester to another.

SUMMARY OF INVENTION

In a first embodiment, the invention is a continuous digester for producing chemical cellulose pulp from cellulose chips including: a digester vessel with an upper section attached to a top separator and said vessel at least partially filled with the cellulose chips and a liquor; a top separator at least partially in said upper section having a lower chip inlet port, a chip conveyor, a screen adjacent the conveyor, an upper chip discharge chute, and a liquor outlet facing a side of the screen opposite to the conveyor, and a chip inlet conduit extending into the vessel and having a first operational mode in fluid communication with the chip inlet port and a second operational mode in which the chip inlet conduit discharges directly into the vessel.

In a second embodiment, the invention is a method for converting a vapor phase continuous digester to a hydraulic phase digester, wherein the digester comprises a digester vessel; a top separator in an upper section of the digester vessel and said further comprising a lower chip inlet port, a chip conveyor, a screen adjacent the conveyor, an upper chip discharge chute, and a liquor outlet facing a side of the screen opposite to the conveyor, and a chip inlet conduit extending into the vessel and having a coupling to the lower chip inlet port, said method comprising: operating the vapor phase digester in a vapor phase mode wherein a chip slurry flows through the chip inlet conduit through the lower chip inlet port and is moved up through the top separator, is discharged from the upper chip discharge chute into an upper vapor region of the vessel and falls to a liquor filled region of the region; ceasing the flow of the chip slurry to the chip inlet port; removing a bottom from the top separator; establishing a chip slurry flow path to an upper portion of top separator, and filling the vessel with liquor and chips such that the chip discharge chute is immersed.

In a third embodiment, the invention is a method for converting a vapor phase continuous digester to a hydraulic phase digester, wherein the digester comprises a digester vessel; a top separator in an upper section of the digester vessel and further comprising a lower chip inlet port, a chip conveyor, a screen adjacent the conveyor, an upper chip discharge chute, and a liquor outlet facing a side of the screen opposite to the conveyor, and a chip inlet conduit extending into the vessel and having a coupling to the lower chip inlet port, said method comprising: operating the vapor phase digester in a vapor phase mode wherein a chip slurry flows through the chip inlet conduit through the lower chip inlet port and is moved up through the top separator, is discharged from the upper chip discharge chute into an upper vapor region of the vessel and falls to a liquor filled region of the vessel; ceasing the flow of the chip slurry to the chip inlet port; filling the vessel with liquor and chips such that the chip discharge chute is immersed, and discharging chips directly from the chip inlet conduit into a fluid filled portion of the vessel.

DETAILED DESCRIPTION OF THE DRAWINGS

Figure 1:
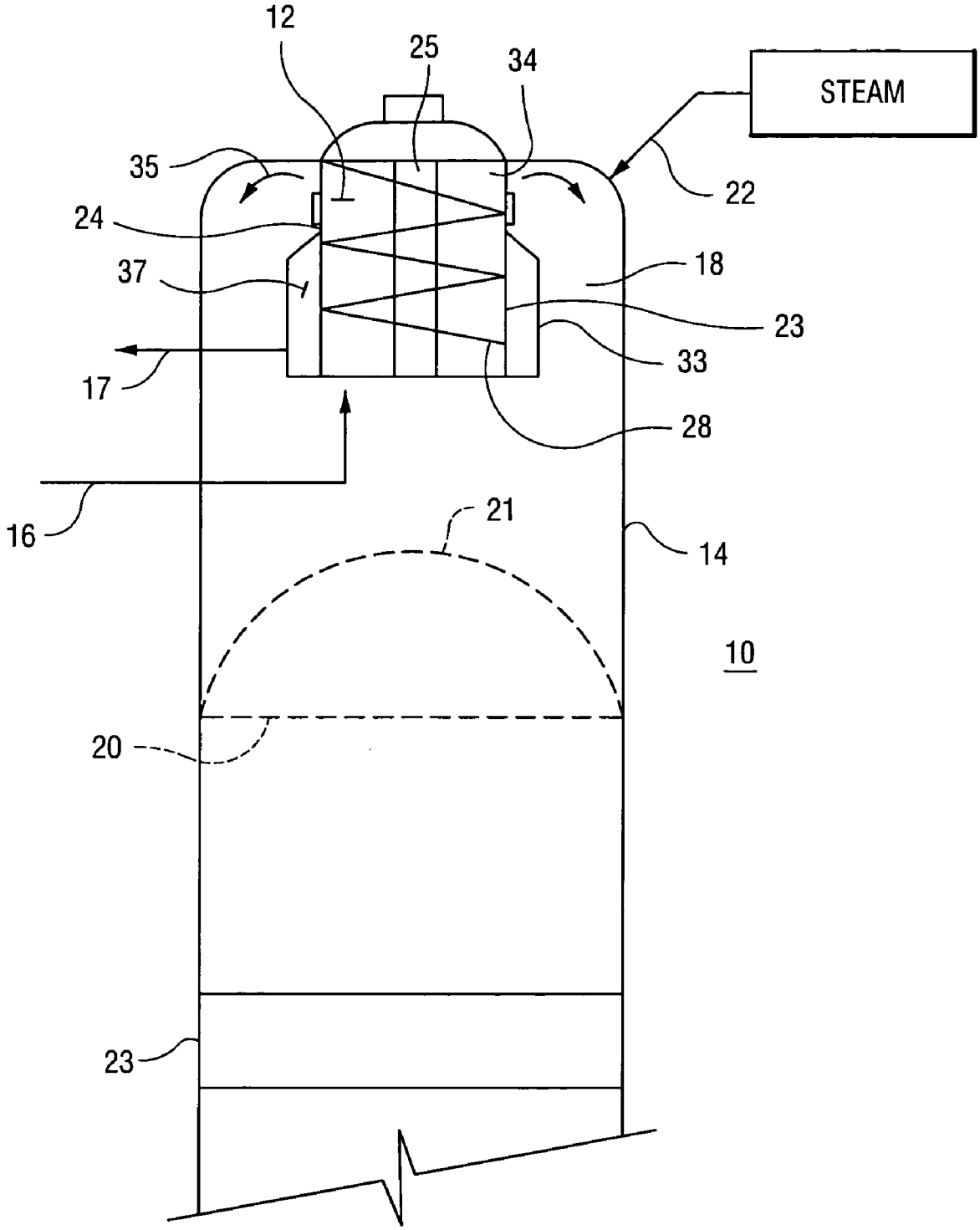
FIG. 1 is a schematic side view of a continuous digester having a top separator.

FIG. 1 illustrates the top section of a continuous digester 10. The digester may be the only digesting vessel in a pulping system, or may be one of two or more vessels, where another vessel may be an impregnation vessel. The digester 10 receives a slurry of comminuted cellulosic fibrous material, typically wood chips, mixed in with cooking liquor, such as kraft white liquor. The slurry is typically first treated in a chip feed system, for example, a Lo-Level™ feed system as sold by Andritz Inc. of Glens Falls, N.Y.

The digester includes a top separator 12 mounted in the top of the digester vessel 14. The separator is within the vessel. Chips flow in a slurry with liquor into the digester through one or more inlet pipes 16. Liquor extracted by the top separator flows out of the digester through one or more liquor outlet pipes 17. The screw conveyor in the digester is turned by a transmission and motor that are coupled to the vertical shaft of the conveyor.

The digester 10 may be a vapor-phase digester or a hydraulic digester. In hydraulic mode, the digester is substantially filled with cooking liquor and chips up to the top of the vessel 14. Vapor, such as steam or inert gas, may be injected at the top of the vapor-phase digester to provide pressure control, heat or other desired functions. When the separator 12 is in a hydraulic digester, the separator is substantially immersed in cooking liquor. The immersion is in contrast to earlier hydraulic digesters in which the separator was arranged on an internal cone in the vessel. Without a cone and when in hydraulic mode, the top separator allows cooking liquor and chips to flow around the outside of the separator, flow into the separator through an upper chip discharge chute and any opening in the bottom of the separator, and fill the interior of the separator.

When the digester is configured as a vapor-phase digester, there is a gas phase 18 above a liquid phase 20 in the vessel 14. The separator 12 is generally entirely in the gas phase 18. The separator is supported in the vessel by support beams (not shown) in both the hydraulic and vapor phase digesters. As chips leave the separator, the chips fall to the top of the chip pile 21, the top of which may protrude into the gas phase 18. The majority of the chip pile is immersed in the liquid phase 20 of the vessel.

The chips and liquor discharged from separator 12 fall through a gas-filled zone 18 onto a chip pile 21. Typically, steam is supplied to the gas zone 18 via a steam conduit 22. Other gases may be combined with steam or used in substitution for steam. To continue the steam heating of the chips, the level of the chip pile 21 is maintained above the level of the cooking liquor 20. After steam heating and as the chips sink down into the vessel, the chips are immersed in cooking liquor as they pass below the liquid level, where the cooking process continues. Screens 23 (at various levels in the liquid portion of the digester) may be used in a conventional manner to remove some black cooking liquor from the chips flowing downward through the vessel 14 of the digester 10. Additional cooking liquor may be injected into the digester, usually at various screen levels. The chips may also be submerged in the liquor as is shown in U.S. Pat. Nos. 5,882,477; 6,024,837 and 6,174,411.

Figure 2:
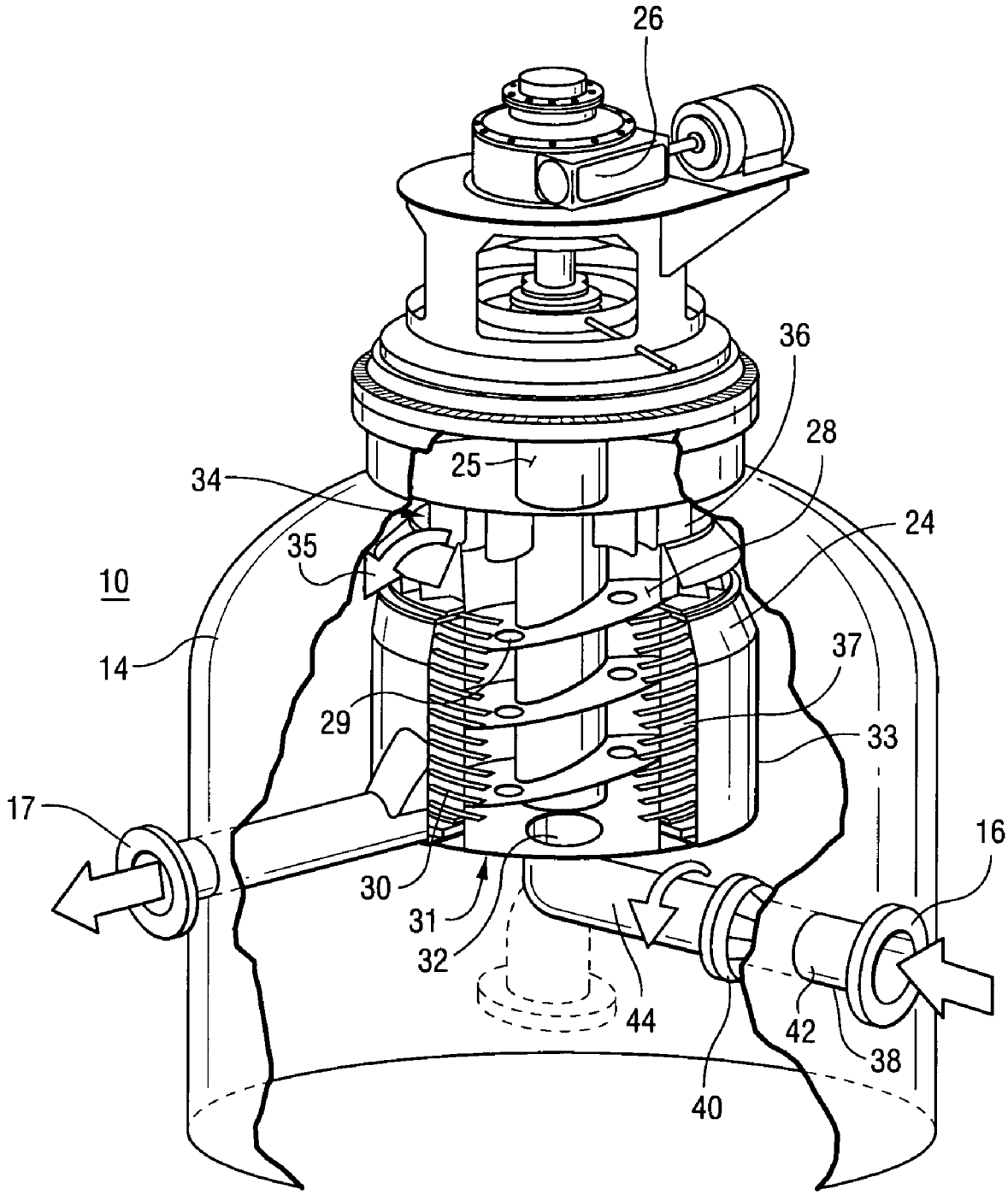
FIG. 2 is a perspective view, partly in cross section, of a top section of a digester with a first embodiment of a top separator.

FIG. 2 is a close-up view of a first embodiment of an inverted the top separator 24, shown in a cut-away view. The separator is attached to the top of the digester vessel and the separator shaft 25 is coaxial with the vessel. The shaft extends upward through the top of the vessel and into a drive mechanism 26 with a motor and transmission. The screw conveyor 28 normally rotates in a single rotational direction. However, the drive mechanism 26 may be configured to allow the rotational direction of the conveyor to be reversed, especially when the digester is converted from hydraulic phase to vapor phase or vice versa.

The screw conveyor 28 is attached to the vertical shaft 25. The conveyor 28 may be formed of a helical sheet of metal that is welded to the shaft. The helical sheet of the conveyor may have pumping holes 29. These holes have, in the past, allowed liquor to flow upstream through the conveyor in a direction opposite to the turn of the screw. Cooking liquor can flow easily through the pumping holes 29 to distribute liquor throughout the separator.

The top separator 24 includes a substantially cylindrical side screen 30 and a bottom screen 31, that together form a screen drum. The drum blocks the passage of chips and fibers while allowing the passage of liquid from the chip slurry. Liquid passing through the screen drum is extracted through the outlet pipe 17. The chips and remainder of the liquid flow are moved upward by the screw conveyor 28 to the chip outlet chute 34. The screw conveyor rotates in the screen drum so as to move the chips upward as they are received through the bottom chip inlet 32. Chips are discharged from the top of the top separator, as indicated by arrow 35. As they are discharged, the chips are exposed to steam and fall onto the underlying chip pile 21 (FIG. 1).

The screen drum allows liquor to pass and prevents the passage of chips and wood fibers. As liquor passes through the screens 30, 31, it flows into an annular volume 37 between the screens and a cylindrical container 33 that forms the outer housing of the separator. The container is connected to one or more outlet pipes 17 that feed extracted liquor to an outlet port on the exterior of the vessel 14.

An annular discharge chute 34 forms an upper region of the container 33 and is above the screw conveyor 28. A ring of paddles 36 on a disk rotate above the conveyor and move the chips flowing from the conveyor towards the discharge chute. Arrow 35 indicates the flow path of the chips being discharged from the separator. From the discharge chute, the chips flow into the open volume of the digester vessel.

A chip inlet pipe 32 extends to the bottom of the separator, as is conventional with an inverted top separator. The inlet pipe includes a flange or other connection 40 between a straight portion 42 of the pipe and an elbow portion 44 that is adapted to connect to the bottom inlet 32 of the separator. The flange 40 allows the elbow 44 to be removed or inverted. The elbow may be removed or inverted in connection with converting the digester from a vapor phase to a hydraulic digester. With the elbow removed or inverted, the chip slurry discharges directly to the vessel interior. The chip slurry flows directly into the liquid that fills the hydraulic digester.

With the elbow 44 removed or inverted, the top separator 24 does not introduce chips into the digester. The bottom of the separator will have an aperture at the inlet 32 where the elbow 44 was previously connected. Cooking liquor and some chips may flow into the aperture of the inlet 32 and enter the separator. As the screw conveyor 28 turns, cooking liquid is driven through the screen and is extracted through the liquor outlet pipe 17. Liquor 30 may also flow into the separator through the annular chip discharge chute 34 at the top of the separator. Liquor flows throughout the separator as the screw rotates and by flowing through the pumping holes in the screw. If chips enter the separator through the bottom inlet 32, the rotation of the screw carries the chips up to the top of the separator where the rotating paddles 36 push the chips out the discharge chute 34. The screw conveyor also scrapes and cleans the inside surface of the screen cylinder 30 as the conveyor rotates.

The liquid level in a hydraulic digester is at the top of the digester. In an essentially hydraulic digester (such as a digester that can have a vapor space above the liquid level where the control scheme is one of a vapor digester but the pulp produced has the qualities of a hydraulic digester) the liquid level is at or above the chip discharge chute 34 of the separator. Accordingly, liquor also flows into the separator via the chip discharge chute. The pumping holes 29 allow the liquor entering the top of the separate to flow downward to the bottom of the separator. The screw conveyor is rotating to move liquor and chips upward. Because the pumping holes allow downward flow in the separator, the inlet 32 to the separator may be left open or closed. Alternatively, the entire bottom floor and bottom screen 31 of the separator may be removed so that liquor and chips may be pulled by the rotating conveyor 28 up into the separator. The liquor and chips are discharged 35 from the top of the separator, but a portion of the liquor is extracted through the cylindrical screen 33. With the entire bottom floor removed, the screw conveyor can rotate so as to transport material either upward or downward.

The volume of liquor extracted by the separator should be sufficient for digester operation, even when the interior chip inlet pipe 38 discharges separately from the separator. Because the separator is immersed in the cooking liquor in the hydraulic phase digester, the separator will be filled with cooking liquor which can be screened. The amount of liquor removed from the immersed separator is believed to be comparable to the amount of liquor extracted with conventional top separators in hydraulic digesters with a chip inlet coupled to the separator. Accordingly, the separator can perform its function of removing excess liquor in a hydraulic digester even though relatively few chips move through the separator.

Figure 3:
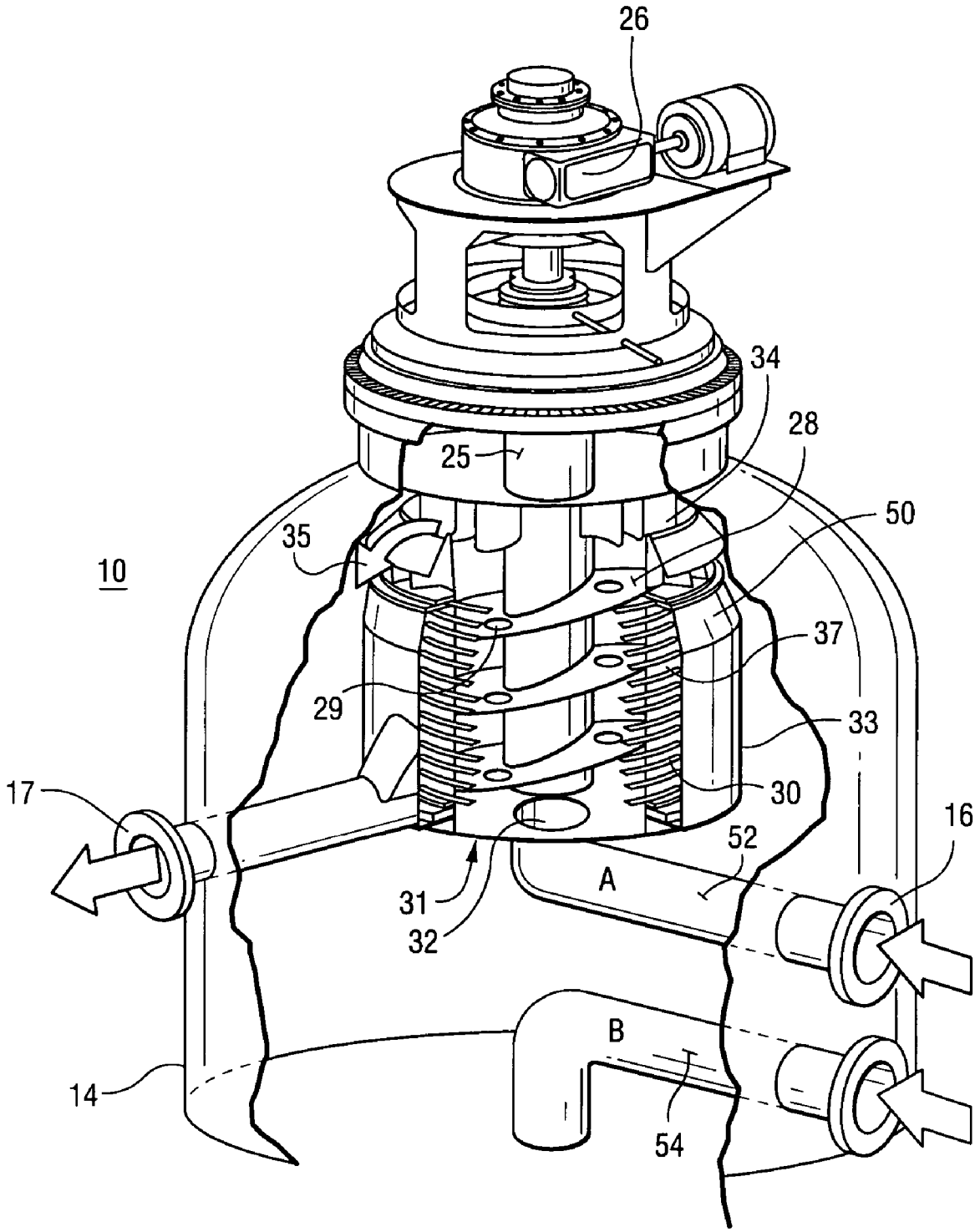
FIG. 3 is a perspective view, partly in cross section, of a top section of a digester with a second embodiment of a top separator.

FIG. 3 shows a second embodiment of top separator 50 that may be converted for operation in a hydraulic or vapor-phase digester. The second top separator 50 is similar in construction as the first top separator 24. The digester has a first chip inlet pipe 52 for vapor phase operation and a second inlet pipe 54 for hydraulic digester operation. The chip inlet for vapor phase operation is connected to a bottom inlet 32 of the separator. The vapor phase chip inlet pipe 52 is coupled to the separator so that all chips flow upward through the separator. Chips are moved through the separator to the upper discharge chute 34 so that the chips may be evenly and annularly distributed from high in the vapor portion of the vessel 14.

The chip inlet pipe 54 for hydraulic phase operation extends to the center axis of the vessel 14 and projects the chip slurry downward into the vessel. The hydraulic inlet pipe 54 does not introduce chips into the separator 50. When in hydraulic operation, the first chip inlet pipe 52 is turned off by a valve and does not introduce chips or liquor into the separator. The bottom inlet 32 to the separator is closed by a valve during hydraulic operation. Liquor flows into the separator through the top chip discharge chute 34, in the manner described above in connection with the first separator embodiment.

Figure 4:
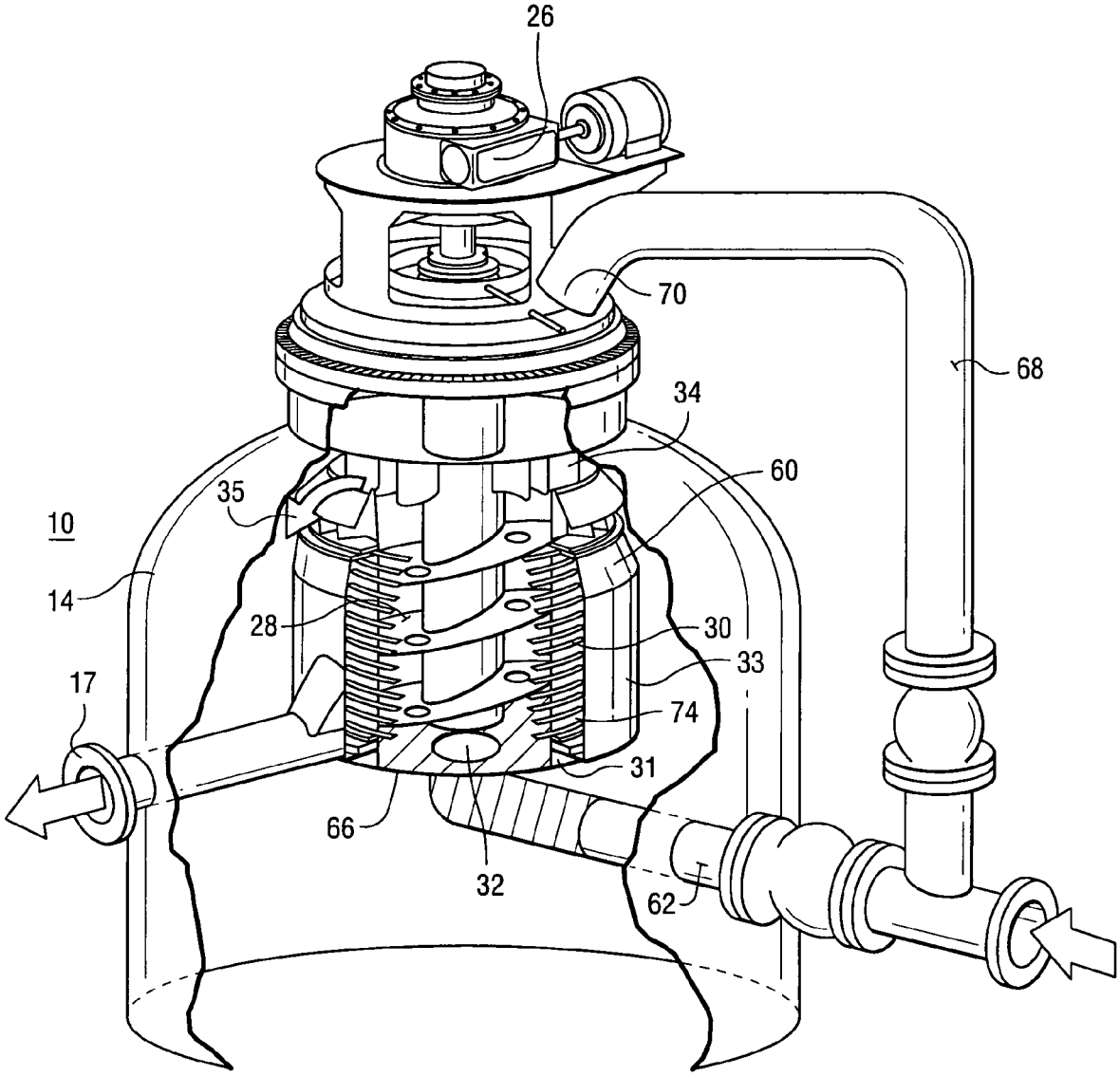
FIG. 4 is a perspective view, partly in cross section, of a top section of a digester with a third embodiment of a top separator.

FIG. 4 shows a third embodiment of top separator 60 that may be converted for operation in a hydraulic or vapor-phase digester. The third top separator may be operated as an inverted top separator with a bottom chip slurry inlet 62 while the vessel 14 is in a vapor phase digester mode. In this vapor phase mode, the chip slurry enters the bottom inlet 32 of the separator and is moved upwards by the screw conveyor 28 through the screen drum 30, 31 housed in the container 33. The paddles 36 discharge the chips and liquor out through the annular chip discharge ring 34 in the direction of arrow 35. A portion of the liquor in the slurry moving upwards through the screw is extracted through the screen drum and outputted through the liquor outlet 17. This vapor phase operation of the top separator is common to the first, second and third embodiments of the top separator 24 and 50.

To convert to hydraulic phase operation, the inside of the vessel portion 64 of the bottom chip inlet pipe is removed. Similarly, the bottom floor 66 of the screen container 33 is removed, along with any bottom screen 31. The removal of the inlet pipe 62 and bottom 66 leaves the bottom of the separator open to the flow chips and liquor. In addition, the rotational direction of the screw conveyor 28 is reversed so that the chip slurry is moved through the separator from top to bottom. In addition, a top chip slurry inlet pipe 68 is added to feed the slurry into the top 70 of the separator.

Modifications may be needed to the upper portion of the digester and top separator to provide a flow passage for the chip slurry. However, top inlets for separators are well known and typically provide a chip flow passage to the center vertical axis of the separator. The inlet flow passage 68 is arranged to prevent the chip slurry from being discharged out the upper discharge chute 34. However, it is not critical to disable the upper discharge chute 34 because chips discharged from the upper chute will directly enter the liquid filled portion of the hydraulic digester in a similar manner as the chips flowing out the bottom of the separator. Moreover, liquor will fill the interior of the separator regardless of whether some chips flow out the upper discharge chute 34.

During hydraulic phase operation, the chip slurry flows through the inlet pipe 68 into the top inlet 70 of the separator. A portion of the chips may or may not flow out the upper discharge chute 34. If the upper discharge chute 34 is open, additional liquor and some chips may flow in through the chute into the interior of the top separator. The screw conveyor 28 turns so as to move the chip slurry downward through the separator. A portion of the liquor in the conveyor passes through the cylindrical screen 30 and flows into an annular chamber 37 between the screen 30 and cylindrical container 33. The extracted liquor in the chamber 37 flows through the liquor outlet pipe 17 and may be reused in the chip feed system or in another application in the pulp processing plant. The majority of the chips and liquor flowing downward through the separator are discharged out the open bottom of the separator and into the liquid filled volume of the hydraulic phase digester vessel.

The preferred embodiments of the invention, as now known by the inventors, are fully described here in sufficient detail such that one of ordinary skill in the art is able to make and use the invention using no more than routine experimentation. The embodiments disclosed herein may not be all of the possible embodiments of the invention. Other embodiments of the invention that are within the sprite and scope of the claims are also covered by this patent.

What is claimed is:

1. A top separator configured to be used in a continuous digester for producing chemical cellulose pulp from cellulose chips having a digester vessel with an upper section wherein said vessel is at least partially filled with the cellulose chips and a liquor, said top separator comprising:

a lower chip inlet port, a chip conveyor, a screen adjacent the conveyor, an upper chip discharge chute, and a liquor outlet facing a side of the screen opposite to the conveyor, and a chip inlet conduit adapted to extend through the vessel and to an external chip source, said inlet conduit having a first operational mode in fluid communication with the chip inlet port and a second operational mode in which the chip inlet conduit discharges directly into the vessel, wherein the chip inlet conduit includes a single inlet pipe extending through the vessel for both the first operational mode and the second operational mode, and wherein the chip inlet conduit includes a chip slurry conduit between the inlet pipe and the chip conveyor during the first operational mode and the chip inlet conduit includes a chip slurry discharge discharging a chip slurry directly to the vessel and the chip slurry discharge is integral with or coupled to the inlet pipe during the second operational mode.

2. The top separator as in claim 1 wherein the inlet pipe further comprising a coupling at an section of the conduit in the vessel and upstream of a connection to the chip inlet port, wherein the coupling switches the inlet conduit between the first operation mode and the second operational mode.

3. The top separator as in claim 2 wherein the coupling is a flange coupling.

4. The top separator as in claim 1 wherein said screen further comprises a bottom screen, and said bottom screen is detached while said chip inlet is in the second operational mode.

5. The top separator as in claim 1 wherein said conveyor is a screw conveyor having a first rotational direction used while said chip inlet in said first operational mode and a second rotational direction used while said chip inlet is in said second operational mode.

6. The top separator as in claim 1 wherein the digester is a vapor phase digester when the chip inlet port is in said first operational mode and is a hydraulic digester when the chip inlet port is in said second operational mode.

7. A top separator configured to be used in a continuous digester for producing chemical cellulose pulp from cellulose chips having a digester vessel with an upper section wherein said vessel is at least partially filled with the cellulose chips and a liquor, said top separator comprising:

a lower chip inlet port, a chip conveyor, a screen adjacent the conveyor, an upper chip discharge chute, and a liquor outlet facing a side of the screen opposite to the conveyor, and a chip inlet conduit adapted to extend through the vessel and to an external chip source, said inlet conduit having a first operational mode in fluid communication with the chip inlet port and a second operational mode in which the chip inlet conduit discharges directly into the vessel, wherein the chip inlet conduit further comprises a first chip inlet pipe extending into the vessel and in fluid communication with the chip inlet port and a second chip inlet pipe extending into the vessel and having a discharge port directly open to the vessel and below the separator.

8. A top separator for a continuous digester for producing chemical cellulose pulp from cellulose chips, wherein said vessel is at least partially filled with the cellulose chips and a liquor, said top separator comprising:

a chip conveyor, a screen adjacent the conveyor, an upper chip discharge chute, and a liquor outlet facing a side of the screen opposite to the conveyor, and a chip inlet conduit extending into the vessel and having a first operational mode discharging a chip slurry to the chip conveyor and a second operational mode discharging the chip slurry directly into the vessel separately of the chip conveyor, wherein the chip inlet conduit includes a single inlet pipe extending through the vessel for both the first operational mode and the second operational mode and wherein the chip inlet conduit includes a chip slurry conduit between the inlet pipe and the chip conveyor during the first operational mode and the chip inlet conduit includes a chip slurry discharge discharging the chip slurry directly to the vessel and the chip slurry discharge is integral with or coupled to the inlet pipe during the second operational mode.

9. The top separator as in claim 8 wherein the vessel is filled with liquor up to a level at least above the upper chip discharge chute of the separator.

10. A continuous digester as in claim 8 wherein the vessel is filled with liquor up to a level at least above the upper chip discharge chute of the separator and liquor flows into the upper chip discharge chute.

* * * * *